United States Patent [19]

Keller

[11] 3,986,623

[45] Oct. 19, 1976

[54] CONTROL SYSTEM FOR APPARATUS FOR PLUCKING AND TRANSPORTING FIBERS

[75] Inventor: Alex Jacques Keller, Gastonia, N.C.

[73] Assignee: Automatic Material Handling, Inc., Bessemer City, N.C.

[22] Filed: July 23, 1975

[21] Appl. No.: 598,434

[52] U.S. Cl. ..... 214/16 R; 19/145.5

[51] Int. Cl.[2] ..... D01G 13/00

[58] Field of Search ..... 214/16 R, 17 C, 17 CA, 214/86, 89, 658; 212/127; 294/110 R; 19/81, 145.5

[56] References Cited

UNITED STATES PATENTS

| | | | |
|---|---|---|---|
| 3,577,599 | 5/1971 | Goldammer | 19/145.5 |
| 3,777,908 | 12/1973 | Keller | 214/16 R |

*Primary Examiner*—Trygve M. Blix
*Assistant Examiner*—Jesus D. Sotelo
*Attorney, Agent, or Firm*—Richards, Shefte & Pinckney

[57] ABSTRACT

For use with fiber feeding machines having a plurality of fiber bales arranged in two rows extending from each machine, and a fiber plucker device that moves along such bales to pluck fibers therefrom and transport the plucked fibers to such machines, a control system by which the fiber plucker device is selectively operable to pluck fibers from a predetermined number of bales in one bale row of each machine and to then automatically proceed directly to pluck fibers from a predetermined number of bales in the other bale row of such machine. A control system is also disclosed for causing the fiber plucker device to pluck fibers sequentially from both bale rows behind one or more of the fiber feeding machines, and to pluck fibers, alternatively, from only one of the two bale rows behind other fiber feeding machines. Additional control means are provided for selectively determining the number and combination of bales which are plucked from any row of bales by the fiber plucker device.

14 Claims, 4 Drawing Figures

CONTROL SYSTEM FOR APPARATUS FOR PLUCKING AND TRANSPORTING FIBERS

BACKGROUND OF THE INVENTION

In U.S. Pat. No. 3,777,908 and co-pending U.S. application Ser. No. 568,853 , filed Apr. 17, 1975, there is disclosed an apparatus for plucking fibers from a plurality of bales arranged in two parallel rows behind each of a plurality of fiber feeding machines, as for example bale opener machines like those disclosed in U.s. Pat. No. 3,132,709 to Lytton, and delivering such plucked fibers to the fiber feeding machines. This apparatus generally includes a fiber plucker device that is automatically transported along and across the rows of bales on an elevated track system or the like, and an automatic control system is provided for determining the particular bales from which fiber is plucked.

More specially, each fiber feeding machine includes a photo-electric cell which produces a signal when the hopper of such fiber feeding machine is empty or requires more fibers, and the fiber plucker, in response to receiving such signal, is moved to a position adjacent the signaling machine whereupon it moves along one or the other of the rows of bales behind such machine and sequentially plucks fibers from each bale in the row and then transports the plucked fibers to the signaling maching where the fibers are released into hopper thereof. Two rows of longitudinally aligned bales are located behind each machine to permit replenishing of one row without interrupting or interferring with the plucking operation from the other row, and to permit a large number of bales (e.g. ten bales) to be placed directly behind a hopper having a limited width. The control system includes a selector switch which has three settings, namely "left," "right, " and "automatic."

AT the left setting, the fiber plucker device will only travel down the left bale row of any signaling machine to pluck fibers sequentially from the bales therein, while at the right setting the fiber plucker device will operate similarly along the right bale row of any signaling hopper. At the automatic setting, the fiber plucker device will first pluck fibers from the left bale row in response to a signal from a machine, and, upon return to such machine in response to a later signal, will pluck fibers from the right bale row, after which it will continue to alternate between such rows in response to subsequent signals.

It is to be noted that in this prior art machine, the fiber plucker stops at each bale in a bale row to remove fibers therefrom and then delivers such fibers to the corresponding machine, whereupon it returns to the next bale in such row and repeats the process sequentially for every bale in the row.

While this operational sequence works quite satisfactory in most fiber blending operations, particularly those where a desired fiber blend requires blending of fibers from a relatively large number of bales in a bale laydown, it has been found that this equipment has certain drawbacks where "short" blends are desired which require fibers from only a small number of bales (e.g. between 2 and 6) of different fiber content.

Thus, if the equipment is designed for five bale positions in each row of bales and only two different bales are necessary for a particular blend, it was necessary to remove the other bales from three of the bale positions in a row, and while this adjustment resulted in the proper fibers being taken to the hopper for blending, it resulted in a significant waste of time because the fiber plucker nevertheless traveled to the empty bale positions and went through the motions of plucking fibers from non-existent bales. Since the empty bale positions would almost always be the bale positions farthest from the hopper, the time waste became even more acute.

This time waste, in addition to the obvious result of limiting the number of hoppers which one fiber plucker could reasonably service, also resulted in some cases in inconsistent blends of inferior quality because of the time lag caused by the fiber plucker going to a number of empty bale positions. Such inferior blends are even more frequent where the plurality of of fiber feeding machines are arranged to form stacked layers of fibers onto a common conveyor belt because a time lag in getting the proper quantity of plucked fibers to a particular fiber feeding machine could result in an inadequate layer of fibers being deposited on the common conveyor belt.

In accordance with the present invention, the control system for the fiber feeding and transporting equipment has been improved to render such equipment more versatile, and to improve the manner in which such equipment deals with the drawbacks of the prior art equipment as discussed above.

SUMMARY OF THE INVENTION

The present invention provides a selectively operable bale selector control having a plurality of control settings, each such control setting acting to cause the fiber plucker device to automatically pluck fibers in sequence from only bales in predetermined bale positions within a particular row of bales extending behind a fiber feeding machine and to deliver such plucked fibers from such predetermined bales to the fiber feeding machine. The number and combination of the predetermined bale positions is different for each control setting whereby the bales from which fiber is pluched can be selectively controlled.

Preferably, the number of bale positions in any bale row is at least as great as the number of control settings, and a series of control settings are provided including a first setting whereby fiber is caused to be plucked only from the bale position nearest the fiber feeding machine and a plurality of additional settings, each of which adds one additional bale in the bale row to the number of bales plucked. For example, the first control setting would cause only the bale nearest the fiber feeding machine to be plucked, and the second control setting would cause only the two bales nearest the fiber feeding machine to be plucked, and so on.

Additionally, the present invention provides a selectively operable sequence control which, in addition to the left, right and automatic controls discussed above, acts to cause the fiber plucker means to automatically pluck fibers in sequence from a predetermined number of bales in one of the two rows of bales behind a fiber feeding machine and to then automatically proceed directly to pluck fibers from a predetermined number of bales in the other row of bales.

By adding the aforementioned controls, the present invention makes it possible for the fiber plucker to pluck fibers from only a selected number of the bale positions included in a given row of bales, preferably those nearest the fiber feeding machine adjacent such row, whereby no time is wasted by the fiber plucker traveling to all bale positions. Moreover, since the sequence control also permits the fiber plucker to move automatically from one bale row to the other bale row behind a fiber feeding machine, it is possible to control the fiber plucker whereby it will pluck fibers only from the bale positions in both bale rows which are closest to the fiber feeding machine, thereby resulting in a further conservation of time. For example, if a particular blend requires fibers from only two different bales, such bales could be placed in the first or nearest bale position in each of the two rows behind a fiber feeding machine, and by operating the proper controls, the fiber plucker would pluck only from these two bales, in sequence, thereby eliminating the need for the fiber plucker to travel to the second bale position in a bale row which is located at a farther distance from the fiber feeding machines.

Several advantages are realized from the aforementioned control system of the present invention. First, since the required travel of the fiber plucker is substantially reduced in short blend operations, a single fiber plucker can be used to feed a greater number of fiber feeding machines while also eliminating the aforementioned problem of having inferior quality blends as the result of a time lag between deposits of fibers in a fiber feeding machine as discussed above. Also, it is possible to reduce the floor space for a given bale laydown because of the fiber pluckers ability to pluck fibers in sequence from the nearest bales in two bale rows rather than from the same number of bales in one bale row extending a greater distance from the fiber feeding machine. Additionally, since the fiber plucker actually delivers plucked fibers to a hopper more quickly, it can be adjusted to pluck less fibers from each bale and still keep pace with the supply requirements of the hoper rather than possibly "choking" the hopper with a large delivery of fibers at less frequent intervals. Finally, since the fiber plucker deposits plucked fibers in a hopper at one side or the other thereof depending on which bale row is being plucked, a more uniform mix is obtained in the hopper if some plucked fibers are deposited at both sides of the hopper, from both bale rows, rather than only at one side of the hopper, as would be the case if only the bales in one bale row were being plucked and deposited at one side of the hopper.

The present invention also includes a modified control system which is particularly advantageous where either bales of different compression are being fed to different hoppers, or where generally similar bales are being fed a plurality of fiber feeding machines having different fiber consumption rates. This modified control system includes a selectively operable switch having the aforesaid left, right and "sequence" control settings, and an "alternative" control setting at which the fiber plucker is caused to automatically pluck fibers sequentially from the bales in both bale rows behind one group of hoppers, and to pluck fibers, alternatively, from one of the two bale rows behind another group of hoppers.

With this control system, if each of a plurality of similar hoppers has a equal number of bales and bale rows behind it, the fiber plucker will, upon receipt of a signal from a hopper, pluck twice as many bales behind the first group of hoppers as compared with the second group of hoppers. This can be very helpful in situations where, for example, it is desirable to pluck from so-called "hard" bales, or bales under high compression and tightly meshed which makes it difficult for the fiber plucker to remove the normal quantity of fibers from the bale during each plucking operation. Accordingly, these hard bales can be placed behind the first group of hoppers and normal bales can be placed behind the second group of hoppers, and the quantity of fibers delivered to each hopper in each group will be approximately the same since, while twice as many bales behind the first group of hoppers are plucked only about half the quantity of fibers (e.g. 18 ounces from a hard bale as compared with 37 ounces from a normal bale) is removed from each of the hard bales behind the first group of hoppers. Similarly, it is possible to use one fiber plucker to serve two different blending lines, with the hoppers for one blending line requiring twice as much fiber as those of the other blending line. By putting the high demand hoppers in the first group and the low demand hoppers in the second group, the same fiber plucker will keep both blending lines supplied with the correct quantity of fiber.

BRIEF DESCRPTION OF THE DRAWINGS

DESCRIPTION OF THE PREFERRED EMBODIMENT

Figure 1:
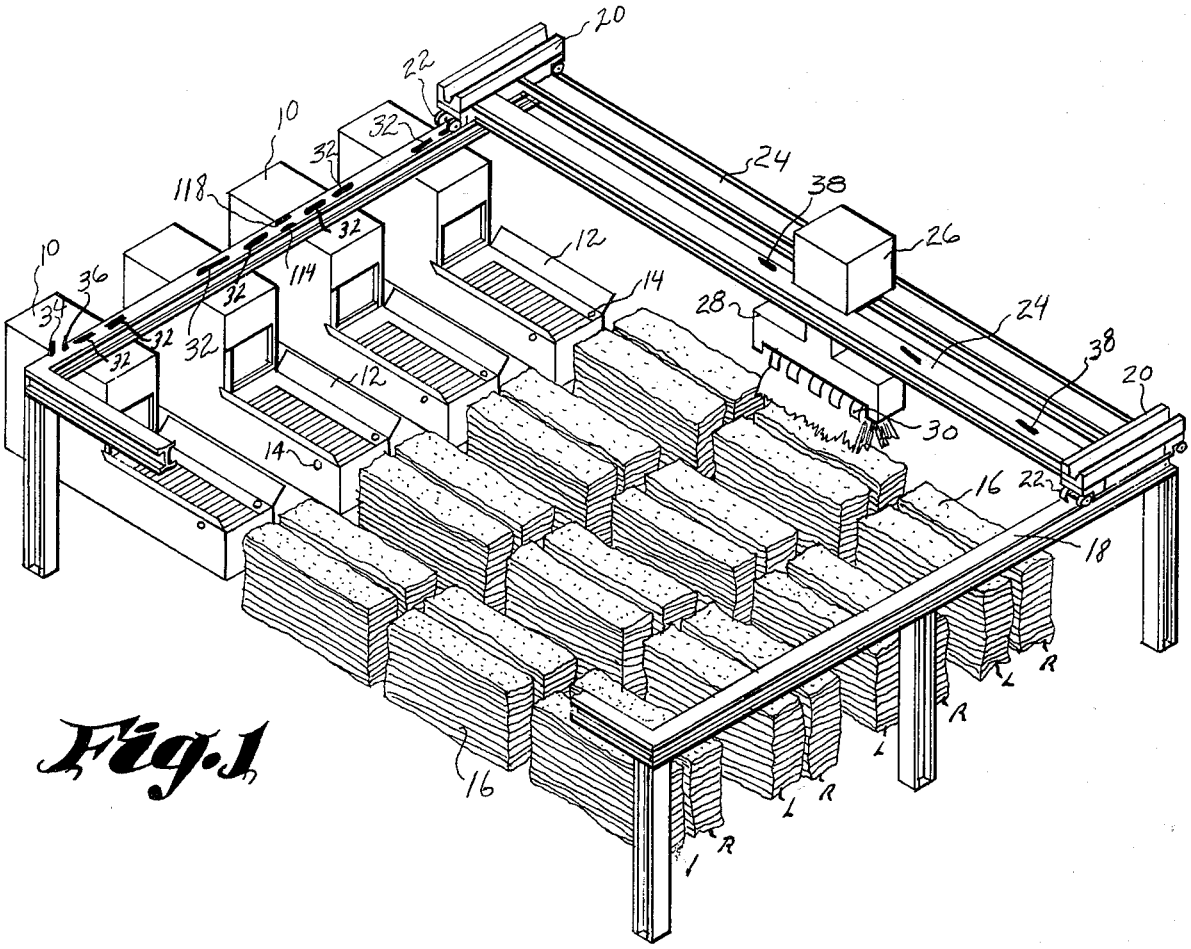
FIG. 1 is a perspective view of fiber plucking and transporting apparatus embodying the present invention.

Looking now in greater detail at the accompanying drawings, FIG. 1 illustrates apparatus for automatically plucking and transporting fibers, such apparatus being of the same general type as that disclosed in the aforementioned Keller U.S. Pat. No. 3,777,908 and U.S. patent application Ser. No. 568,853, filed Apr. 17, 1975.

A plurality of fiber feeding machines 10 are arranged in side-by-side relation, each having a hopper 12 in which a conventional photo-electric cell 14 is arranged to generate an electric signal when the quantity of fibers in any one hopper reaches a predetermined low level, thereby indicating that such hopper requires a further supply of fiber. A plurality of bales of fibers 16 are situated in predetermined adjacent bale positions defining two adjacent, parallel rows of bales extending from each fiber feeding machine 10, the left-hand row of bales 16 for each fiber feeding machine 10 being identified by the letter L in FIG. 1 and the right-hand row of bales 16 being similarly identified by the letter R.

An elevated trackway 18 extends generally over the line of hoppers 12 and the rows of bales 16 in the bale laydown, and a crane 20 having wheels 22 is mounted on the trackway 18 for movement therealong. The crane 20 includes a pair of parallel tracks 24 extending in a direction generally parallel to the rows of bales 16, and a dolly 26 is carried on the tracks 24 by wheels (not shown) for movement therealong. The dolly 26 supports a fiber plucker device 28 arranged for vertical movement with respect to the dolly 26, and the fiber plucker 28 includes a plurality of tongs or finger elements 30 that open and close to pluck fibers from the top surfaces of bales 16 when the fiber plucker 28 is lowered to a predetermined position with respect thereto. The trackway 18 includes a plurality of cams 32 thereon, one cam 32 being located directly above each row of bales 16, and also includes a "start" switch cam 36 and a limit switch cam 34 at the left-hand end of the trackway 18. One of the tracks 24 similarly includes a plurality of cams 38 located therealong at positions corresponding to the bale positions in any row of bales 16.

The crane 20, dolly 26, fiber plucker 28 and finger elements 30 are each powered by a separate electric motor (not shown), and movement of these respective components controlled in a predetermined sequence by an electrical control circuit. For purposes of describing the present invention, this control circuit may be conveniently divided into two parts, namely the prior art control features which are known and which are generally described only insofar as necessary to understand the present invention, and the new control features constituting the present invention.

In the known or prior art apparatus, the crane 20 and dolly 26 always start from the "home" position where the crane 20 is located at the extreme left position of the trackway 18, and the dolly 26 is located at its uppermost position in FIG. 1. When one of the hoppers 12 requires fiber, the photo-electric cell 14 associated therewith generates an electrical signal which causes the control circuit to move the crane 20 along the trackway 18 in a direction toward the right until the crane 20 reaches the appropriate cam 32 at the signaling hopper 12, whereupon the crane 20 stops. The crane 20 will stop with the fiber plucker 28 located above either the bale row L or R of the signaling hopper 12, depending upon the setting of a control circuit line selector switch 40 (see FIG. 3). In the prior art apparatus, this line selector switch 40 included three settings, namely Left, Right and Automatic. If the line selector switch 40 was set on the Left setting, the crane 20 will stop when the fiber plucker 28 is located above the bale row L of the signaling hopper 12; and if such switch 40 is set in the Right setting, the crane 20 will stop when the fiber plucker 28 is located above the bale row R of the signaling hopper 12. If the line selector switch 40 is set on automatic, the crane 20 would alternately stop the fiber plucker 28 over the bale row L or R each time a new signal is received from the hopper 12.

Once the crane 20 positions the fiber plucker 28 above a bale L or R of a signaling hopper 12 in accordance with the setting of the line selector switch 40, the dolly 26 moves along the tracks 24 until it is positioned directly above the bale 16 in such bale row which is nearest to the signaling hopper 12, whereupon the fiber plucker 28 is lowered until it contacts such bale and plucks a quantity of fibers therefrom. The fiber plucker 28 is then raised, and the dolly 26 moves back to a position above the signaling hopper 12 and the quantity of plucked fibers are released to fall into such hopper 12. The dolly 26 then proceeds automatically along the same bale row until it is over the second bale 16 in such bale row, and the plucking and delivery of fibers from the second bale 16 is repeated. This procedure continues until the fiber plucker 28 has plucked fibers from each bale in the particular bale row, and such fibers are delivered to the signaling hopper 12.

After the fiber plucker 28 has plucked fibers from each and every bale 16 in a particular bale row, the dolly 26 returns to its uppermost position on the tracks 24 as seen in FIG. 1, and crane 20 moves to the right until it receives a signal from another hopper 12, in which case the entire above procedure of plucking and transporting the plucked fibers is repeated. When the crane 20 reaches its extreme right-hand position as seen in FIG. 1, it will then automatically return directly to its lefthand "home position" whereby it is again ready to move to the right in response to receiving any signal from one or more of the hoppers 12.

In accordance with the present invention, the aforementioned prior art apparatus is made more versatile and efficient by retaining all of the control features described above while adding selectively operable control means by which the number and combination of bales 16 from which fiber is plucked can be selectively varied.

More specifically, the present invention adds to the previously described line selector switch 40 a sequence setting. At this setting, the crane 20 will respond to a signal from the photo-electric cell 14 of a hopper 12 in the previously described manner, but the crane 20 will automatically stop at the left-hand L bale row of such signaling hopper 12 whereupon the dolly 26 will move along the tracks 24 as aforesaid to permit the fiber plucker 28 to pluck and deliver fibers from the bales 16 in the bale row L, and the number of bales 16 in the bale row L which are plucked may also be varied in accordance with a further control feature of the present invention to be described in greater detail presently. When the fiber plucker 28 has plucked fibers from each of the desired bales 16 in bale row L, the crane 20 then automatically proceeds directly to the bale row R of the same signaling hopper 12, and the fiber plucker 28 proceeds along the bale row R to pluck fibers from the bales 16 therein and deliver such plucked fibers to the signaling hopper 12 in the previously described manner. Thus, instead of the fiber plucker 28 plucking fibers from the bales 16 in one bale row behind a signaling hopper 12 and then proceeding to the next signaling hopper 12, the sequence setting of the line selector switch 40 causes the fiber plucker 28 to proceed automatically and directly to the other bale row behind such signaling hopper 12.

Additionally, the present invention provides for a bale selector switch 42 (see FIG. 2) which has a plurality of control settings such as A1, A2, A3, the number of such control settings preferably corresponding to the number of bales 16 in each bale row behind a hopper 12, and each such control setting acts to cause the fiber plucker means 28 to automatically pluck fibers in sequence from only bales in preselected bale positions within a row of bales over which the dolly 26 is traveling, the number and combination of such preselected bale positions being different for each of the control settings. In the disclosed embodiment of the present invention, there are three bales 16 in each bale row, and the bale selector switch 42 has three settings, A1, A2 and A3. When the bale selector switch 42 is set at A1, the fiber plucker 28, after being located above a particular bale row of a signaling hopper 12 in accordance with the setting of the line selector switch 40 as previously described, will only pluck fibers from the one bale position located nearest the signaling hopper 12, after which the fiber plucker 28 will be returned to a position over the hopper 12 to deposit the plucked fibers and proceed to another bale row, again depending upon the setting of the line selector switch 40. Similarly, at the A2 setting, the fiber plucker 28 will pluck fibers only form the two bale positions located nearest the signaling hopper 12, and, at the A3 setting, the fiber plucker 28 will pluck fibers from all three bale 16 in the bale row. It is to be understood, of course, that three bale positions in a bale row and three settings for the bale selector switch 42 is simply a typical and practical number, but the present invention is not limited to such number. Any number of bale positions and switch settings could be used, preferably with the first such setting causing fibers to be plucked from the bale position nearest its hopper, and each additional setting in the series causing the fiber plucker 28 to pluck fibers from an additional bale position located in each bale row, such additional bale position preferably being the next nearest bale position to the hopper 12.

Figure 2:
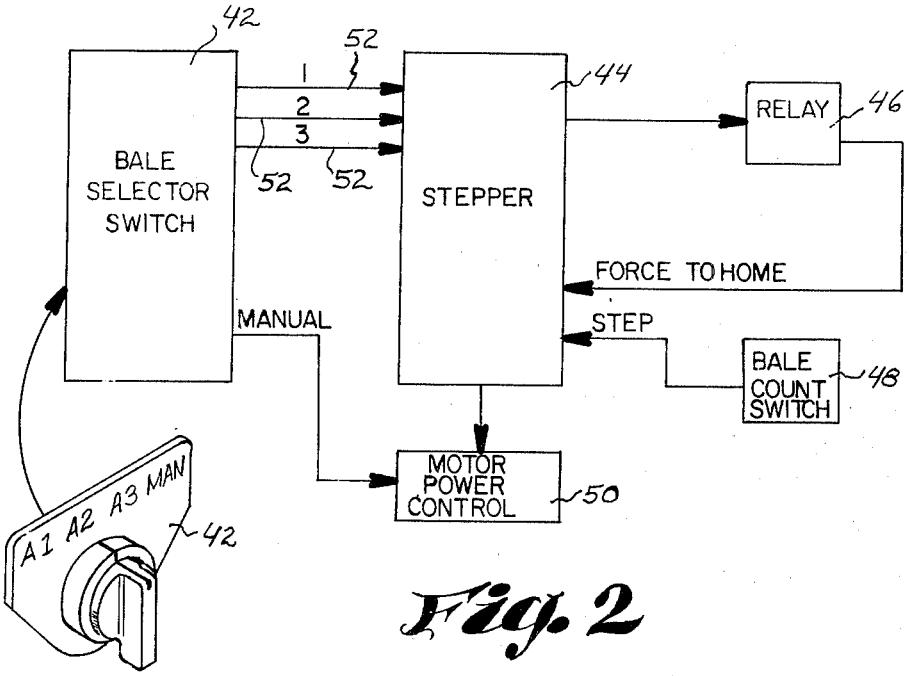
FIG. 2 is a block diagram of the bale selector control circuit of the present invention.
Figure 3:
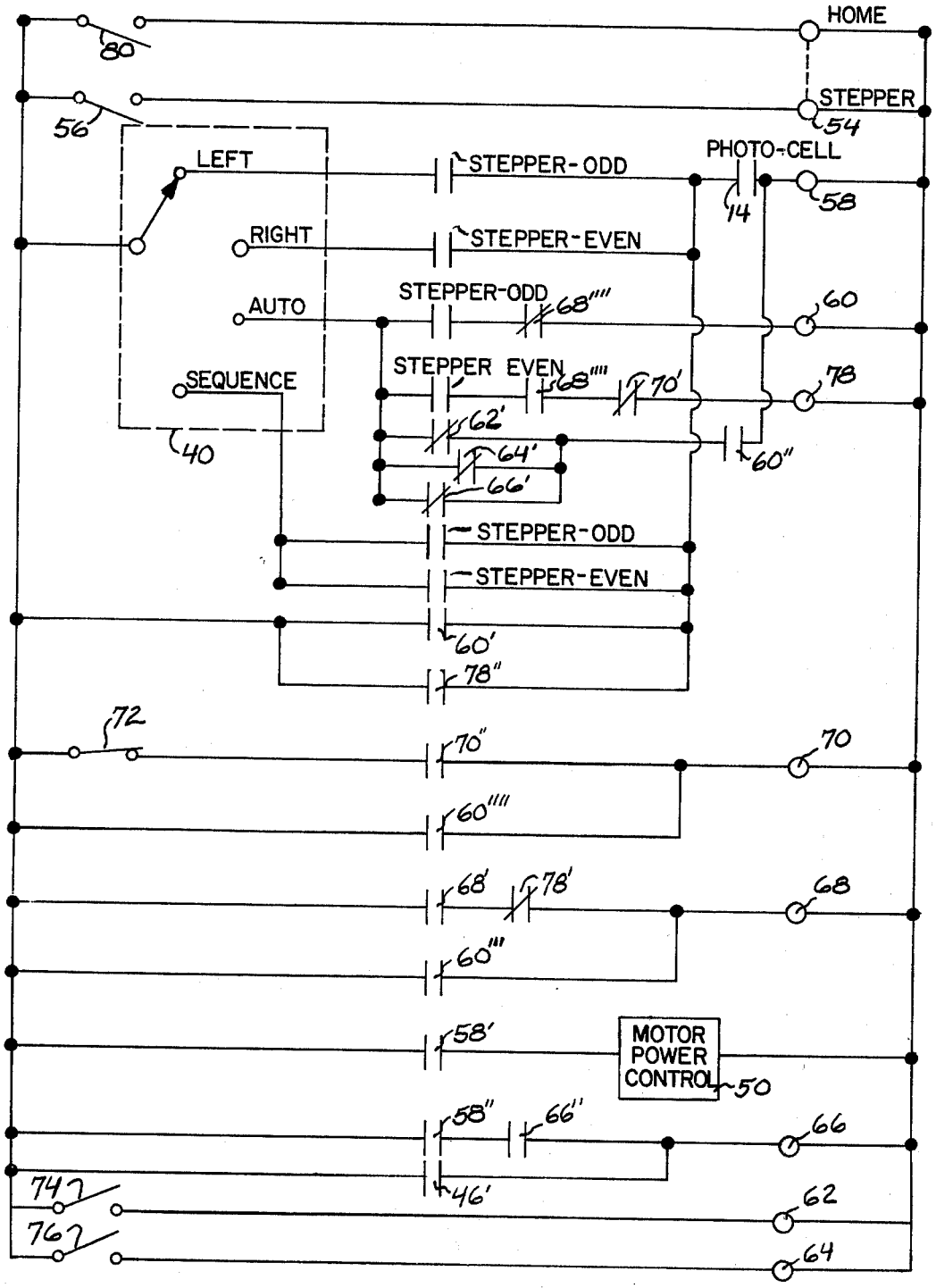
FIG. 3 is a wiring diagram of the sequence selector control of the present invention.

The details of the electric circuits of the previously described control features are not part of the present invention, but FIGS. 2 and 3 illustrate diagrams of suitable electric circuits for such control features.

FIG. 2 shows the aforementioned bale selector switch 42, and the electrical components directly associated therewith, including a conventional stepper unit 44, a relay 46, a bale count switch 48 and a motor control block 50 which represents the various motors and controls therefor which cause the crane 20, dolly 26 and fiber plucker 28 to be moved in the manner described above. The bale count switch 48 is associated with the dolly 26 and is arranged to be temporarily colsed each time the bale count switch 48 passes over, in a rightward direction, one of the aforementioned cams 38 located on one of the tracks 24. In operation, the particular count at which the stepper 44 will operate the relay 46 is determined by the setting (e.g. A1, A2 or A3) of the bale selector switch 42, as indicated by the three lines 52. Each time the dolly 26 passes over one of the cams 38, the bale count switch 48 is temporarily closed to advance the stepper 44 one count. When the stepper 44 is advanced to a point where such count corresponds to the set count determined by the bale selector switch 42, relay 46 is energized to return the stepper 44 to its original or zero condition and to cause the motor power control 50 to then conclude the fiber plucking operation for that bale row. For example, if the bale selector switch 42 is at its A2 setting, the dolly 26 will move to position above the first bale position in a bale row, and fiber is plucked therefrom and deposited in the hopper 12 for such bale row. The dolly 26 will then move in its usual manner to the second bale position in the bale row and fibers are plucked therefrom and deposited in the hopper 12. Since the bale count switch 48 will then have advanced the stepper two counts to correspond with the A2 setting, the plucking operation for that bale row will be concluded by energization of the relay 46 and the fiber plucker will not go to the third bale position in the bale row but will, instead, be in a condition to proceed to the next bale row to be plucked. Thus, depending on the setting of the bale selector switch 42, the fiber plucker 28 can be caused to pluck fibers from only the first bale in a bale row, or from the first two bales in such bale row, or from all three bales in such bale row.

Also, it is to be noted that the bale selector switch 42 may include a manual setting, identified in FIG. 2 as "MAN". At this setting, power is applied directly to the motor power control 50 whereby movement of the crane 20, dolly 26 and fiber plucker 28 can be directly controlled by toggle switches (not shown) or the like which are provided at the drive motors of these components.

FIG. 3 illustrates a wiring diagram of the control circuit associated with the aforementioned line selector switch 40 for each fiber feeding machine 10, and this circuit includes the start switch 36 on the trackway 18, a second stepper unit 54, a line count switch 56 which is mounted on the crane 20 and arranged to advance the stepper unit 54 one count each time the line count switch 56 passes over one of the cams 32 of the trackway 18 when moving toward the right, and a plurality of relays. Also shown is a contact 14' which represents the previously described photo-electric cell 14, it being understood that once the photo-electric cell 14 generates a signal indicating that a hopper 12 requires fibers, the contact 14' for such hopper is closed and remains closed until the fiber plucker 28 has completed one plucking operation at that hopper from one or both of the bale rows therebehind. If such hopper still requires fibers, the photo-electric cell 14 will generate a new signal which will result in additional plucking at such hopper the next time the crane 20 reaches such hopper after monitoring all of the other hoppers for similar signals.

If the line selector switch 40 is set on its Left setting, the stepper unit 54 will operate only on odd counts. When the photo-electric cell 14 of a particular hopper 12 is energized (signaling) and the crane 20 moves to such hopper 12, the cam 32 above the left-hand bale row for such hopper 12 will first engage the line count switch 56 whereby the stepper will be advanced one count. Since this one count is odd, so as to correspond to the odd setting of stepper unit 54, relay 58 will be energized through the energized photo-electric cell 14 so as to cause the motor power control 50 to be energized through contact 58' to thereby stop the crane 20 and cause the dolly 26 and fiber plucker 28 to advance along the left bale row L of the hopper 12 and pluck fibers of the bales in the bale row L. Upon completing the plucking of bales 16 in the bale row L, the crane 20 will then move to the right along trackway 18 and each cam 32 will cause the limit count switch 56 to advance the stepper unit 54 one count. However, since there are two cams 32 above each hopper 12, when the crane 20 arrives at the next signaling hopper 12, the first cam 32 thereat will always advance the stepper 54 to an odd count whereby the aforementioned plucking operation will be repeated at the bale row L of such next signaling hopper 12.

When the line selector switch 40 is set on the right setting , the operation is similar to that just described except that the stepper unit 54 operates only on even counts. Thus, the line count switch 56 will not operate the stepper unit 54 until it has engaged both the left and right bale row cams 32 and advanced the stepper an even two counts, whereupon the dolly 26 and fiber plucker 28 will proceed to pluck fibers from bales 16 in the bale row R of the signaling hopper 12. Upon completion of this operation, the crane will proceed to the bale row R of the next signaling hopper 12.

When the line selector switch 40 is set on the "SEQUENCE" setting, the stepper unit 54 is set to operate on the first odd count, then the next even count, and so on alternatively. Thus, when the line count switch 56 reaches the first or left-hand bale row cam 32 of a signaling hopper 12, the stepper unit 54 will be advanced one count which corresponds to its first odd count setting and the dolly 26 and fiber plucker 28 will be caused by relay 58, contact 58' and motor power control 50 to pluck fibers from the left bale row L of the signaling hopper 12. When this operation is completed, the crane 20 will move toward the right and the line count switch 56 will almost immediately enegage the right-hand bale row cam 32 of the same signaling hopper 12, whereupon the stepper unit 54 will be advanced to an even count and, in the aforesaid manner, the dolly 26 and the fiber plucker 28 will be caused to pluck fibers from the bale row R of the signaling hopper 12.

If the line selector switch 40 is set on its "AUTO" or automatic setting, the stepper unit 54 is set to operate at the first odd count. When the crane 20 reaches the cam 32 at the first odd count. When the crane 20 reaches the cam 32 at the first or left-hand bale row L of a signaling hopper 12, line count switch 56 advances the stepper to an odd count whereby relay 60 is operated through closed contact 68'''', and relay 58 is thereby operated through contact 60' and photo-electric cell 14. When relay 58 is operated, it closes contace 58'and the motor power control 50 is operated to cause the fiber plucker 28 to pluck fiber from the bale row L of the signaling hopper 12. It is to be noted that the operation of relay 60 also closes contact 60'' which establishes a holding circuit for the relay 58 and the motor power control 50 through each of the normally closed contacts 62', 64' and 66' of relays 62, 64, 66 respectively. Also, when the relay 60 is operated, its contact 60''' is closed to operate relay 68 which closes contacts 68', 68'' and 68''' and opens contact 68''''. The closing of contact 68''energizes relay 70 to open contact 70' and close contact 70''.

The three aforementioned relays 62, 64 and 66 which act to hold the circuit to relay 58 as described above are separately controlled, respectively, by a switch 74 which is closed when fiber plucker 28 is lowered, a switch 76 which is closed when the finger elements 30 of the fiber plucker 28 are closed, and a normally open contact 46' which is closed when the relay 46 of FIG. 2 is operated. Thus, when the fiber plucker 28 is lowered, and finger elements 30 are closed, and the bale count stepper 44 reaches a condition to operate relay 46, all of the contacts 62', 64' and 66' will be opened and the holding cirucit through relay 58 is opened to thereby open contact 58' and conclude the operation of the motor power control 50 for that bale row of the fiber machine 10.

When the fiber plucker 28 has completed plucking the bales in bale row L, the crane 20 moves to the right and contacts immediately the cam 32 above the right bale row R. However, since contact 70' is now open, the even count circuit of stepper 54 will not operate and the crane 20 will continue its movement to the right searching for another signaling hopper. When the crane 20 ultimately reaches the right-hand end of the trackway 18, it automatically returns to its start position at the left-hand end of the trackway 18, and during this leftward movement none of the switches and cams are operative since they are only actuated during rightward movement of the crane 20.

When the crane 20 reaches its start position at the left, the aforementioned start switch cam 36 operates a start switch 80 which forces the stepper until 54 to its zero or home condition. Additionally, the crane 20 opens a limit switch 72 which opens the circuit through relay 70, whereby contact 70' is closed, and it will be noted that contact 68'''' is open and contact 68''' is closed because relay 68 has remained energized through contact 68' and contact 78'. Accordingly, when the crane 20 receives a further signal from the same hopper just described, it returns thereto and passes the cam 32 above the left bale row L which was just plucked. However, since contact 68'''' is open, the odd stepper circuit is open, and the crane 20 will continue moving until it reaches the cam 32 above the adjacent right bale row R whereupon the stepper 54 will be advanced to an even count and energize relay 78 through closed contacts 68''' and 70'. This will close contact 78'' to energize relay 58 and thereby close the circuit through the motor power control 50, and the plucking operation will proceed along the right bale R in the same way as that described above in connection with left bale row L.

Also, the energization of relay 78 opens contact 78' to thereby de-energize relay 68 whereby contacts 68'''' and 68''' will return to their closed and open conditions, respectively. Accordingly, when the crane 20 again returns to the fiber feeding machine 10 in question, the control circuit will be in a condition to again operate on an odd stepper count so that the left bale row L will be plucked. Thus, in the AUTO setting, the bale rows L and R of each fiber feeding machine 10 will be alternately plucked each time the fiber plucker 28 receives a new signal from such machine.

Thus, it will be apparent that the above-described control features of the present invention add significantly to the versatility of the prior art plucking and transporting apparatus. By virtue of the bale selector control switch 42, the fiber plucker 28 can be made to pluck from one, or two, or all three bales 16 in any bale row, and this optional feature can be used at all settings of the line selector switch 40. Accordingly, the fiber plucker 28, in all operations of the apparatus, can be made to pluck fibers from desingated bales in a bale row, after which the fiber plucker 28 can proceed immediately to the next bale row to be plucked. This results in substantial time savings in situations where only one or two bales in a bale row are to be plucked because the fiber plucker 28 does not go to unnecessary, empty bale positions as was previously the case.

The line selector switch particularly when combined with the bale selector switch 42, 40, offers even greater versatility. For example, if a two bale mix is required in the hoppers 12, the line selector switch 40 can be set at its SEQUENCE setting and the bale selector switch at its A1 setting, and the fiber plucker 28 will go to the first bale in bale row L of a signaling hopper 12 and will then proceed immediately to the first bale in bale row R of such hopper 12. This sequence of operation is to be contrasted with the prior operation which required, for a two bale mix, the fiber plucker 28 to go to the first bale in a given bale row and then to the second bale in such row. Obviously, the first bale position in the second row is closer to the hopper 12 than the second bale position in the first bale row, and a significant time saving is realized by having the fiber feeder go to both first bale positions in two bale rows rather than two bale positions of one bale row. This time savings provides all of the advantages referred to above, and additionally distributes the plucked fibers more evenly in the hopper 12 since such fibers are deposited from two bale rows at each side of the hopper 12. Finally it is to be noted that floor space behind the hopper 12 is conserved.

Additionally, if it is desirable to have as many as six bales fed into a hopper 12 in response to a signal therefrom, the line selector switch 40 can be set on its SE- QUENCE setting, and the bale selector switch 42 can be set at its A3 setting. Each time a signal is generated by a hopper 12, the fiber plucker 28 will pluck fibers from all three bales in bale row L and then proceed directly to pluck fibers from all three bales in bale row R. Thus, even though the bale laydown is only three bales deep behind each hopper, each hopper can be supplied, in one operational sequence, with fibers from six different bales.

Figure 4:
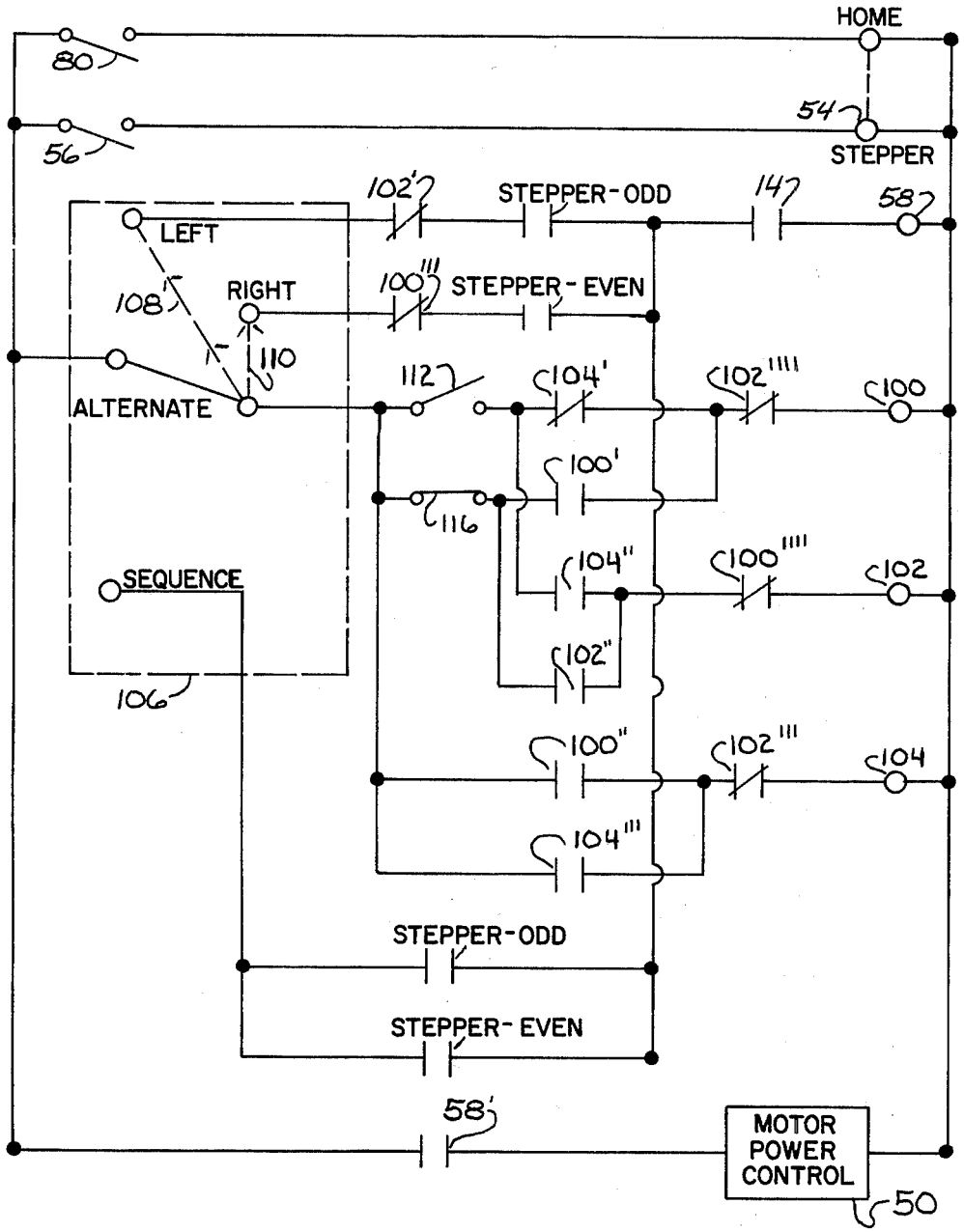
FIG. 4 is a wiring diagram of the alternative selector control of the present invention.

FIG. 4 illustrates a modified control circuit for the fiber feeding machine 10 which is selectively operable to cause the fiber plucker 28 to pluck fibers in sequence from both rows L and R behind preselected hoppers 12, and to pluck fibers, alternatively, from other preselected hoppers 12. As discussed above, this control system is particularly useful in situations where the fiber requriements of the hoppers is significantly different, or where the nature of the bales being plucked is such that different quantities of fibers are removed from different bales during each plucking operation.

In FIG. 4, many of the components are identical to those previously described in connection with the operation of the circuit in FIG. 3, and these components have the same reference numerals in FIGS. 3 and 4. Moreover, it will be noted that the line selector switch 106 has left, right and sequence settings all of which correspond to the similar settings in the line selector switch 40 is FIG. 3 and all of which operate in the same manner as that previously described. Additionally, the line selector switch 106 includes an alternative contact at which it can be set, and this alternative contact is electrically connected as indicated by lines 108, 110 to connect the left and right contacts, respectively, in circuit with the alternative contact when the line selector switch 106 is selectively set at the latter contact.

The circuit from the alternative contact includes a normally open set switch 112 which is carried by the crane 20 and which is temporarily closed when the crane 20 moves toward the right and passes over a cam 114 disposed on the trackway 18 between the first two and the last two hoppers 12 as illustrated in FIG. 1. This circuit also includes a normally closed reset switch 116 which is also carried by the crane 20 and which is temporarily opened by a similarly positioned cam 118 when the crane 20 moves thereover while traveling toward the left as seen in FIG. 1. The cams 114 and 118 could be positioned on the trackway 18 between any two hoppers 12, as will be explained presently.

When the line selector switch 106 is set on the alternative contact as illustrated in FIG. 4, it will be noted that as the crane 20 begins moving toward the right from its start position, it will move over the first two left-hand hoppers 12 before reaching the aforementioned cams 114 and 118. If either or both of these first two hoppers 12 are signaling for fibers, the fiber plucker 28 will be caused to pluck fibers in sequence from both bale rows behind such signaling hoppers 12. More specifically, since the alternative contact is connected to the left and right contacts, when the crane 20 reaches the left bale row of the first hopper 12, the stepper 54 will be advanced to an odd count by the cam 32 above such left bale row and a circuit will be completed through the left contact, closed contact 102', the stepper-odd contact, photo-electric cell 14 and relay 58, to thereby close contact 58' and operate Motor Power Control 50 as previously described. After plucking fibers from a predetermined number of bales in the left bale row, the crane 20 again moves to the right and immediately engages the next cam 32 above the right balerow of the same hopper 12, whereupon the stepper 54 is advanced to an even count, and a similar circuit is completed through the right contact to energize the relay 58 and operate the Motor Power Control 50 whereby the fiber plucker 28 plucks fibers from a predetermined number of bales in the right bale row of such hopper 12.

When the crane 20 moves toward the right from the second hopper 12, the cam 114 will temporarily close the set switch 112 which thereby operates the relay 100 to close contacts 100' and 100'' and open contacts 100''' and 100''''. The opening of contact 100 ''' opens the circuit through the right contact and the stepper-even contact. As a result, if either of the two hoppers 12 to the right of cam 114 are signaling, the fiber plucker 28 will only pluck fibers from the left bale row behind one or both of such hoppers 12 in response to the odd stepper counts.

When the crane 20 reaches its extreme right position, it will automatically move to the left to its start position as previously described, and during this leftward movement, the reset switch 116 will be temporarily opened by the cam 118. When reset switch 116 is opened the holding circuit through relay 100 and contact 100' is opened and relay 100 is de-energized to close contact 100''' whereby the stepper-even circuit is once again operative. Also, it will be noted that relay 104 is energized through its holding contact 104''', the relay 104 having been originally energized through contact 100'' when switch 112 was closed as described above.

With the circuit in this condition, the crane 20 will return to start and begin moving to the right again. As it passes over the first two hoppers 12, both of which are to the left of cam 114, it will pluck fibers in sequence from both of the bale rows behind such hoppers 12 if they are signaling, all in the same manner as that described immediately above. However, when the crane 20 reaches the cam 114, set switch 112 will be temporarily closed to thereby complete a circuit through contact 104'' (now closed because of the prior energization of relay 104), contact 100'''' and relay 102. This energizing of relay 102, closes contact 102'' to provide a holding circuit, opens contact 102''' to de-energize relay 104, and opens contact 102' to render the left contact and stepper-odd circuit inoperative. Accordingly, on the second pass of the crane 20 above the two right-hand hoppers 12 in FIG. 1, the fiber plucker 28 will be caused to pluck fibers only from the right-hand bale row behind such hoppers 12. When the crane 20 reaches its extreme right-hand position, it will again automatically move toward the left to its start position, and cam 118 will temporarily open reset switch 116 whereupon the holding circuit through relay 102 will be opened, and the FIG. 4 circuit will return to its original condition as shown.

Accordingly, with the control circuit illustrated in FIG. 4, the line selector switch 106 may be selectively set on left, right or sequence and operate at these settings in the same manner as that described in connection with the FIG. 3 control circuit. Additionally, the control circuit includes an alternative setting which permits the fiber feeding machine 10 to pluck fibers in sequence from both bale rows behind one or more of the hoppers 12, and , for the remaining hoppers 12, to pluck fibers, alternatively, from only one row of bales. Thus, in the arrangement illustrated in FIG. 1, the two left hoppers would have all six bales therebehind plucked each time the hoppers signal, and the two right hoppers would have only three bales therebehind plucked (alternately from bale rows L and R) each time one of these hoppers signal for more fiber. Thus, if the aforementioned hard bales are used in a blend, they would be placed behind the two left hoppers, and normal bales would be placed behind the two right hoppers, whereby substantially the same quantity of fibers would be delivered to all four hoppers. Also, if all of the bales are normal bales, the two left hoppers could be placed in one blending line having double the fiber requirements as another blending line containing the two right hoppers.

It is to be understood, of course, that the number of hoppers may be varied from that shown in FIG. 1, and the cams 114 and 118 can be placed between any two hoppers, all depending upon the particular requirements of the system being supplied with plucked fibers. Also, the previously described bale selector switch 42 can also be used in combination with the FIG. 4 control circuit to selectively vary the number of bales in the bale rows which are plucked.

Finally, it is within the scope of the present invention to combine the alternative circuit in FIG. 4 with the entire control circuit shown in FIG. 3. It is to be noted, in this regard, that the circuitry for the left, right and sequence contacts are the same in both FIG. 3 and FIG. 4, and it is therefore apparent that it is possible to include, in a single circuit, the circuitry of FIG. 3 with the alternative circuit of FIG. 4 added thereto and to provide switching whereby either the alternative or automatic operations, as described above, can be selectively utilized with the same fiber feeding machine.

The present invention has been described in detail above for purposes of illustration only and is not intended to be limited by this description or otherwise to exclude any variation or equivalent arrangement that would be appartent from, or reasonably suggested by the foregoing disclosure to the skill of the art.

I claim:

1. In combination with a fiber feeding machine having a plurality of bales of fibers situated in predetermined adjacent bale positions defining at least one row of bales extending from said fiber feeding machine, and a fiber plucker means operable in response to a signal from said fiber feeding machine to move along said row of bales and pluck fibers therefrom for delivery to said fiber feeding machine, the improvement comprising selectively operable bale selector control means having a plurality of control settings, each such control setting acting to cause said fiber plucker means to automatically pluck fibers in sequence from only bales in preselected bale positions within said row of bales, the number and combination of said preselected bale positions being different for each said control setting whereby the bales from which fiber is plucked by said fiber plucker means can be selectively controlled.

2. In the combination defined in claim 1, the improvement being further characterized in that the number of adjacent bale positions in said rows of bales is at least as great as the number of said control settings of said bale selector control means, and in that said plurality of control settings includes a first setting at which fiber is plucked only from the bale position located nearest said fiber feeding machine and a series of additional control settings, each of which causes said fiber plucker means to pluck fiber from one additional bale in said bale row.

3. In combinatin with a fiber feeding machine having a plurality of bales of fibers situated in predetermined adjacent bale positions defining at least two adjacent, parallel rows of bales extending from said fiber feeding machine, and a fiber plucker means operable in response to a signal from said fiber feeding machine to move along said rows of bales and pluck fibers therefrom for delivery to said fiber feeding machine, the improvement comprising selectively operable sequence control means acting to cause said fiber plucker means to automatically pluck fibers in sequence from a predetermined number of bales in one of said rows of bales for delivery to said fiber feeding machine and to then automatically proceed directly to pluck fibers in sequence from a predetermined number of bales in said other row of bales.

4. In the combination defined in claim 3, the improvement being further characterized in that selectively operable bale selector control means is provided for selectively varying said predetermined number of bales in each said row of bales from which fibers are plucked by said fiber plucker means.

5. In the combination defined in claim 4, the improvement being further characterized in that said bale selector control means includes a plurality of control settings, each such control setting acting to cause said fiber plucker means to automatically pluck fibers in sequence from only bales in preselected bale positions in each of said rows of bales, the number and combination of said preselected bale positions being different for each said control setting whereby the bales in each row of bales from which fiber is plucked by said fiber plucker means can be selectively controlled.

6. In the combinatin defined in claim 5, the improvement being further characterized in that said plurality of control settings are in a series in which the first control setting causes said fiber plucker means to pluck fibers only from the bale position in each said bale row located nearest said fiber feeding machine and each subsequent control setting in said series causes said fiber plucker means to pluck fiber from one additional bale in each said bale row.

7. In combination with a plurality of fiber feeding machines each having a plurality of bales of fibers situated in predetermined adjacent bale positons defining first and second adjacent, parallel rows of bales extending from each of said fiber feeding machines, a movable fiber plucker means for plucking fibers from said bales and delivering said plucked fibers to said fiber feeding means, and first control means operable in response to a signal from any one of said fiber feeding machines to cause said fiber plucker means to move along a selected one of said rows of bales extending from said signaling fiber feeding machine and pluck fibers from bales in said selected row of bales and deliver said plucked fibers to said signaling fiber feeding machine, the improvement comprising a selectively operable sequence control means acting to cause said fiber plucker means in response to said signal to automatically pluck fibers from a predetermined number of bales in one of said rows of bales and to then automatically proceed directly to pluck fibers from a predetermined number of bales in said other row of bales.

8. In the combination defined in claim 7, the improvement being further characterized in that a selectively operable bale selector control means is provided and includes a series of control settings, the first said control setting said series causing said fiber plucker means to pluck fibers only from the bale position in each said bale row located nearest said fiber feeding machine and each subsequent control setting is said series causing said fiber plucker means to pluck fibers from one additional bale in each said bale row.

9. In combination with a plurality of fiber feeding machines each having a plurality of bales of fibers situated in predetermined adjacent bale positions defining first and second adjacent, parallel rows of bales extending from each of said fiber feeding machines, a movable fiber plucker means for plucking fibers from said bales and delivering said plucked fibers to said fiber feeding means, and signal means associated with each of said fiber feedng machines for indicating when each said machine requires fibers to be fed thereto, the improvement comprising a selectively operable alternative control means acting to cause said fiber plucker means in response to said signal from at least one of said fiber feeding machines to automatically pluck fibers from bales in both of said rows of bales behind said one fiber feeding machine for delivery thereto, and to cause said fiber plucker means in response to said signal from at least one other of said fiber feeding machines to automatically pluck fibers from bales in only one of said rows of bales behind said other fiber feeding machine for delivery thereto.

10. In the combination definced in claim 9 the improvement being further characterized in that each time said alternative control means receives a new signal from said other fiber feeding machine, said fiber plucker means is caused to pluck fibers alternatively from one and then the other of said two rows of bales behind said other fiber feeding machine.

11. In the combination defined in claim 9, the improvement being further characterized in that selectively operable bale selector means is provided for selectively varying the number of bales in each said row of bales from which fibers are plucked by said fiber plucker means.

12. In the combination defined in claim 9, the improvement being further characterized in that said alternative control means causes said fiber plucker means to automatically pluck fibers in sequence from a predetermined number of bales in one of said rows of bales behind said one fiber feeding machine for delivery thereto and to then automatically proceed directly to pluck fibers in sequence form a predetermined number of bales in the other of said rows of bales behind said one fiber feeding machine for delivery thereto.

13. In the combination defined in claim 12, the improvement being further characterized in that each time said alternative control means receives a new signal form said other fiber feeding machine, said fiber plucker means is caused to pluck fibers alternatively from one and then the other of said two rows of bales behind said other fiber feeding machine.

14. In the combination defined in claim 13, the improvement being further characterized in that selectively operable bale selector means is provided for selectively varying the number of bales in each row of bales from which fibers are plucked by said fiber plucker means.

* * * * *

PO-1050
(5/69)

UNITED STATES PATENT OFFICE
CERTIFICATE OF CORRECTION

Patent No. 3,986,623 Dated October 19, 1976

Inventor(s) Alex Jacques Keller

It is certified that error appears in the above-identified patent and that said Letters Patent are hereby corrected as shown below:

Column 2, line 39, delete "pluched" and insert therefor --plucked--; Column 3, line 49, after "fed" insert --to--; Column 3, line 60, delete "a" and insert therefor --an--; Column 7, line 26, delete "colsed" and insert therefor --closed--; Column 9, line 3, delete "enegage" and insert therefor --engage--; Column 9, lines 12 and 13, after "count." delete "When the crane 20 reaches the cam 32 at the first odd count."; Column 9, lines 19 and 20, delete "contace" and insert therefor --contact--; Column 9, line 62, delete "until" and insert therefor --unit--; Column 10, line 35, delete "desingated" and insert therefor --designated--; Column 10, line 42, after "switch" insert --40--; Column 10, line 43, delete "40"; Column 10, line 55, before "row" insert --bale--; Column 11, line 29, delete "is" and insert therefor --in--; Column 14, line 3, delete "combinatin" and insert therefor --combination--; Column 14, line 36, delete "combinatin" and insert therefor --combination--; Column 15, line 2, after "setting" insert --in--; Column 15, line 5, delete "is" and insert therefor --in--; Column 15, line 16, delete "feedng" and insert therefor --feeding--; Column 15, line 29, delete "definced" and insert therefor --defined--; Column 16, line 16, delete "form" and insert therefor --from--; and Column 16, line 29, after "each" insert --said--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*